US006045674A

United States Patent [19]

Castegnier

[11] Patent Number: 6,045,674

[45] Date of Patent: Apr. 4, 2000

[54] INTERMITTENT ELECTROCOAGULATION PRINTING METHOD AND APPARATUS

[75] Inventor: Adrien Castegnier, Outremont, Canada

[73] Assignee: Elcorsy Technology Inc., Saint-Laurent, Canada

[21] Appl. No.: 09/430,019

[22] Filed: Oct. 29, 1999

[51] Int. Cl.[7] ..... C25D 13/04

[52] U.S. Cl. ..... 204/486; 204/483; 204/508; 204/623; 101/DIG. 29

[58] Field of Search ..... 204/486, 483, 204/508, 623; 101/DIG. 29

[56] References Cited

U.S. PATENT DOCUMENTS

| | | | |
|---|---|---|---|
| 4,661,222 | 4/1987 | Castegnier | 204/180.9 |
| 4,895,629 | 1/1990 | Castegnier et al. | 204/180.9 |
| 5,538,601 | 7/1996 | Castegnier | 204/486 |
| 5,750,593 | 5/1998 | Castegnier et al. | 523/161 |
| 5,908,541 | 6/1999 | Castegnier | 204/486 |

*Primary Examiner*—Kishor Mayekar
*Attorney, Agent, or Firm*—Swabey Ogilvy Renault

[57] ABSTRACT

An image is reproduced and transferred onto a substrate by (a) providing a positive electrode having a continuous passivated surface moving at constant speed and defining a positive electrode active surface; (b) forming on the positive electrode active surface a plurality of dots of colored, coagulated colloid representative of a desired image, by electrocoagulation of a colloid present in an electrocoagulation printing ink containing a coloring agent; and (c) bringing a substrate into contact with the dots of colored, coagulated colloid to cause transfer of the colloid from the positive electrode active surface onto the substrate and thereby imprint the substrate with the image. Step (b) is carried out by providing a first and a second series of negative electrodes each having a surface covered with a passive oxide film, the negative electrodes of each series being electrically insulated from one another and arranged in rectilinear alignment so that the surfaces thereof define a plurality of corresponding negative electrode active surfaces disposed in a respective plane spaced from the positive electrode active surface by a respective constant predetermined gap; coating the positive electrode active surface with an olefinic substance; filling the electrode gaps with the electrocoagulation printing ink; and electrically energizing selected ones of the negative electrodes of the first and second series in a controlled alternate manner such that the electrodes of the first series are energized prior to formation of a gelatinous deposit on the surface of each energized electrode of the second series and the electrodes of the second series are energized prior to formation of a further gelatinous deposit on the surface of each energized electrode of the first series.

42 Claims, 3 Drawing Sheets

INTERMITTENT ELECTROCOAGULATION PRINTING METHOD AND APPARATUS

BACKGROUND OF THE INVENTION

The present invention pertains to improvements in the field of electrocoagulation printing. More particularly, the invention relates to an intermittent electrocoagulation printing method and apparatus.

In U.S. Pat. No. 4,895,629 of Jan. 23, 1990, Applicant has described a high-speed electrocoagulation printing method and apparatus in which use is made of a positive electrode in the form of a revolving cylinder having a passivated surface onto which dots of colored, coagulated colloid representative of an image are produced. These dots of colored, coagulated colloid are thereafter contacted with a substrate such as paper to cause transfer of the colored, coagulated colloid onto the substrate and thereby imprint the substrate with the image. As explained in this patent, the positive electrode is coated with a dispersion containing an olefinic substance and a metal oxide prior to electrical energization of the negative electrodes in order to weaken the adherence of the dots of coagulated colloid to the positive electrode and also to prevent an uncontrolled corrosion of the positive electrode. In addition, gas generated as a result of electrolysis upon energizing the negative electrodes is consumed by reaction with the olefinic substance so that there is no gas accumulation between the negative and positive electrodes.

The electrocoagulation printing ink which is injected into the gap defined between the positive and negative electrodes consists essentially of a liquid colloidal dispersion containing an electrolytically coagulable colloid, a dispersing medium, a soluble electrolyte and a coloring agent. Where the coloring agent used is a pigment, a dispersing agent is added for uniformly dispersing the pigment into the ink. After coagulation of the colloid, any remaining non-coagulated colloid is removed from the surface of the positive electrode, for example, by scraping the surface with a soft rubber squeegee, so as to fully uncover the colored, coagulated colloid which is thereafter transferred onto the substrate. The surface of the positive electrode is thereafter cleaned by means of a plurality of rotating brushes and a cleaning liquid to remove any residual coagulated colloid adhered to the surface of the positive electrode.

When a polychromic image is desired, the negative and positive electrodes, the positive electrode coating device, ink injector, rubber squeegee and positive electrode cleaning device are arranged to define a printing unit and several printing units each using a coloring agent of different color are disposed in tandem relation to produce several differently colored images of coagulated colloid which are transferred at respective transfer stations onto the substrate in superimposed relation to provide the desired polychromic image. Alternatively, the printing units can be arranged around a single roller adapted to bring the substrate into contact with the dots of colored, coagulated colloid produced by each printing unit, and the substrate which is in the form of a continuous web is partially wrapped around the roller and passed through the respective transfer stations for being imprinted with the differently colored images in superimposed relation.

The positive electrode which is used for electrocoagulation printing must be made of an electrolytically inert metal capable of releasing trivalent ions so that upon electrical energization of the negative electrodes, dissolution of the passive oxide film on such an electrode generates trivalent ions which then initiate coagulation of the colloid. Examples of suitable electrolytically inert metals include stainless steels, aluminium and tin.

As explained in Applicant's U.S. Pat. No. 5,750,593 of May 12, 1998, the teaching of which is incorporated herein by reference, a breakdown of passive oxide films occurs in the presence of electrolyte anions, such as $Cl^-$, $Br^-$ and $I^-$, there being a gradual oxygen displacement from the passive film by the halide anions and a displacement of adsorbed oxygen from the metal surface by the halide anions. The velocity of passive film breakdown, once started, increases explosively in the presence of an applied electric field. There is thus formation of a soluble metal halide at the metal surface. In other words, a local dissolution of the passive oxide film occurs at the breakdown sites, which releases metal ions into the electrolyte solution. Where a positive electrode made of stainless steel or aluminium is utilized in Applicant's electrocoagulation printing method, dissolution of the passive oxide film on such an electrode generates $Fe^{3+}$ or $Al^{3+}$ ions. These trivalent ions then initiate coagulation of the colloid.

When using negative electrodes made of an active metal such as iron, Applicant has observed that the metal undergoes dissolution in the ink in the presence of the aforesaid electrolyte anions, whether the electrodes are energized or not, resulting in corrosion of the negative electrodes and contamination of the ink. In addition, the metal ions which are released into the ink as a result of such a dissolution cause the formation of a gelatinous material which deposits onto the surfaces of the negative electrodes, thereby creating an electrical resistance which increases as the amount of deposited gelatinous material increases, leading to a complete blocking of the electrical signal.

When using negative electrodes made of a passive metal such as chromium, nickel, stainless steel and titanium which have a passive oxide film on their surface, Applicant has observed that when the electrodes are not energized, there is no formation of the aforesaid gelatinous deposit. On the other hand, when the negative electrodes are energized, there is formation of the gelatinous deposit. It is believed that gas generated as a result of electrolysis and not consumed by reaction with the aforesaid olefinic substance causes a breakdown of the passive oxide film and a local dissolution of the latter at the breakdown sites, resulting in a release of metal ions into the ink and formation of the gelatinous deposit.

SUMMARY OF THE INVENTION

It is therefore an object of the present invention to overcome the above drawbacks and to provide an improved electrocoagulation printing method and apparatus, wherein undesirable formation of the above gelatinous deposit is avoided.

According to one aspect of the invention, there is provided an electrocoagulation printing method comprising the steps of:

a) providing a positive electrolytically inert electrode having a continuous passivated surface moving at substantially constant speed along a predetermined path, the passivated surface defining a positive electrode active surface;

b) forming on the positive electrode active surface a plurality of dots of colored, coagulated colloid representative of a desired image, by electrocoagulation of an electrolytically coagulable colloid present in an electrocoagulation printing ink comprising a liquid colloidal dispersion containing the electrolytically coagulable colloid, a dispersing medium, a soluble electrolyte and a coloring agent; and c) bringing a substrate into contact with the dots of colored, coagulated colloid to cause transfer of the colored, coagulated colloid from the positive electrode active surface onto the substrate and thereby imprint the substrate with the image;

the improvement wherein step (b) is carried out by:

i) providing a first and a second series of negative electrolytically inert electrodes each having a surface covered with a passive oxide film, the negative electrodes of each series being electrically insulated from one another and arranged in rectilinear alignment so that the surfaces thereof define a plurality of corresponding negative electrode active surfaces disposed in a respective plane spaced from the positive electrode active surface by a respective constant predetermined gap, the first and second series of negative electrodes being arranged in spaced-apart parallel relationship with the negative electrodes of each series being spaced from one another by a distance at least equal to the respective electrode gap;

ii) coating the positive electrode active surface with an olefinic substance to form on the surface micro-droplets of olefinic substance;

iii) filling the electrode gaps with the aforesaid electrocoagulation printing ink;

iv) electrically energizing selected ones of the negative electrodes of the first and second series in a controlled alternate manner such that the electrodes of the first series are energized prior to an undesirable formation of a gelatinous deposit on the electrode active surface of each energized electrode of the second series and the electrodes of the second series are energized prior to an undesirable formation of a further gelatinous deposit on the electrode active surface of each energized electrode of the first series, thereby causing point-by-point selective coagulation and adherence of the colloid onto the olefin-coated positive electrode active surface opposite the electrode active surfaces of the energized negative electrodes while the positive electrode active surface is moving; and v) removing any remaining non-coagulated colloid from the positive electrode active surface.

According to another aspect of the invention, there is also provided an electrocoagulation printing apparatus comprising:

a positive electrolytically inert electrode having a continuous passivated surface defining a positive electrode active surface;

means for moving the positive electrode active surface at a substantially constant speed along a predetermined path;

means for forming on the positive electrode active surface a plurality of dots of colored, coagulated colloid representative of a desired image, by electrocoagulation of an electrolytically coagulable colloid present in an electrocoagulation printing ink comprising a liquid colloidal dispersion containing the electrolytically coagulable colloid, a dispersing medium, a soluble electrolyte and a coloring agent; and means for bringing a substrate into contact with the dots of colored, coagulated colloid to cause transfer of the colored, coagulated colloid from the positive electrode active surface onto the substrate and thereby imprint the substrate with the image;

the improvement wherein the means for forming the dots of colored, coagulated colloid comprise:

a first and a second series of negative electrolytically inert electrodes each having a surface covered with a passive oxide film, the negative electrodes of each series being electrically insulated from one another and arranged in rectilinear alignment so that the surfaces thereof define a plurality of corresponding negative electrode active surfaces disposed in a respective plane spaced from the positive electrode active surface by a respective constant predetermined gap, the first and second series of negative electrodes being arranged in spaced-apart parallel relationship with the negative electrodes of each series being spaced from one another by a distance at least equal to the respective electrode gap;

means for coating the positive electrode active surface with an olefinic substance to form on the surface micro-droplets of olefinic substance;

means for filling the electrode gaps with the electrocoagulation printing ink;

means for electrically energizing selected ones of the negative electrodes of the first and second series in a controlled alternate manner such that the electrodes of the first series are energized prior to an undesirable formation of a gelatinous deposit on the electrode active surface of each energized electrode of the second series and the electrodes of the second series are energized prior to an undesirable formation of a further gelatinous deposit on the electrode active surface of each energized electrode of the first series, thereby causing point-by-point selective coagulation and adherence of the colloid onto the olefin-coated positive electrode active surface opposite the electrode active surfaces of the energized negative electrodes while the positive electrode active surface is moving; and means for removing any remaining non-coagulated colloid from the positive electrode active surface.

Applicant has found quite unexpectedly that by providing two series of negative electrolytically inert electrodes each having a surface covered with a passive oxide film and electrically energizing selected ones of the negative electrodes of these two series in a controlled alternate manner as defined above, the aforesaid gelatinous deposit does not form in an amount sufficient to create an electrical resistance which is detrimental to the electrocoagulation. It is believed that the passive oxide film of each energized electrode does not dissolve into the ink in a quantity sufficient to cause an undesirable formation of the gelatinous deposit and, upon de-energization, the passive oxide film rebuilds itself due to the presence of oxidizing substances in the ink. Preferably, the energizing of the negative electrodes of the first and second series is controlled to provide a continous formation of the dots of colored, coagulated colloid on the positive electrode active surface.

According to a preferred embodiment, the negative electrodes of each series are mounted to a respective elongated electrode carrier along the length thereof. It is also possible to mount the negative electrodes of the first and second series to a single elongated electrode carrier along the length thereof. Preferably, the negative electrodes of the first and second series each have a cylindrical configuration with a circular cross-section and a diameter ranging from about 20 $\mu$ to about 50 $\mu$. Where the negative electrodes are mounted to a single electrode carrier, the first and second series of such negative electrodes are spaced from one another by a distance ranging from about 250 to about 1000 $\mu$.

As explained in Applicant's U.S. Pat. No. 4,895,629, the teaching of which is incorporated herein by reference, spacing of the negative electrodes from one another by a distance which is equal to or greater than the electrode gap prevents the negative electrodes from undergoing edge corrosion. On the other hand, coating of the positive electrode with an olefinic substance prior to electrical energization of the negative electrodes weakens the adherence of the dots of coagulated colloid to the positive electrode and also prevents an uncontrolled corrosion of the positive electrode. In addition, gas generated as a result of electrolysis upon energizing the negative electrodes is consumed by reaction with the olefinic substance so that there is no gas accumulation between the negative and positive electrodes. Applicant has found that it is no longer necessary to admix a metal oxide with the olefin substance; it is believed that the passive oxide film on currently available electrode contains sufficient metal oxide to act as catalyst for the desired reaction.

Examples of suitable electrolytically inert metals from which the negative electrodes can be made include chromium, nickel, stainless steel and titanium; stainless steel is particularly preferred. The positive electrode, on the other hand, can be made of stainless steel, tin or aluminum. The gap which is defined between the positive and negative electrodes can range from about 35 $\mu$ to about 100 $\mu$, the smaller the electrode gap the sharper are the dots of coagulated colloid produced. Where the electrode gap is of the order of 50 $\mu$, the negative electrodes are preferably spaced from one another by a distance of about 75 $\mu$.

Examples of suitable olefinic substances which may be used to coat the surface of the positive electrode in step (b)(ii) include unsaturated fatty acids such as arachidonic acid, linoleic acid, linolenic acid, oleic acid and palmitoleic acid and unsaturated vegetable oils such as corn oil, linseed oil, olive oil, peanut oil, soybean oil and sunflower oil. Oleic acid is particularly preferred. The micro-droplets formed on the surface of the positive electrode active surface generally have a size ranging from about 1 to about 5 $\mu$.

The olefin-coated positive active surface is preferably polished to increase the adherence of the micro-droplets onto the positive electrode active surface, prior to step (b)(ii). For example, use can be made of a rotating brush provided with a plurality of radially extending bristles made of horsehair and having extremities contacting the surface of the positive electrode. The friction caused by the bristles contacting the surface upon rotation of the brush has been found to increase the adherence of the micro-droplets onto the positive electrode active surface.

Where a polychromic image is desired, steps (b) and (c) of the above electrocoagulation printing method are repeated several times to define a corresponding number of printing stages arranged at predetermined locations along the aforesaid path and each using a coloring agent of different color, and to thereby produce several differently colored images of coagulated colloid which are transferred at the respective transfer positions onto the substrate in superimposed relation to provide a polychromic image. It is also possible to repeat several times steps (a), (b) and (c) to define a corresponding number of printing stages arranged in tandem relation and each using a coloring agent of different color, and to thereby produce several differently colored images of coagulated colloid which are transferred at respective transfer positions onto the substrate in superimposed relation to provide a polychromic image, the substrate being in the form of a continuous web which is passed through the respective transfer positions for being imprinted with the colored images at the printing stages. Alternatively, the printing stages defined by repeating several times steps (a), (b) and (c) can be arranged around a single roller adapted to bring the substrate into contact with the dots of colored, coagulated colloid of each printing stage and the substrate which is in the form of a continuous web is partially wrapped around the roller and passed through the respective transfer positions for being imprinted with the colored images at the printing stages. The last two arrangements are described in U.S. Pat. No. 4,895,629.

When a polychromic image of high definition is desired, it is preferable to bring an endless non-extensible belt moving at substantially the same speed as the positive electrode active surface and having on one side thereof a colloid retaining surface adapted to releasably retain dots of electrocoagulated colloid to cause transfer of the differently colored images at the respective transfer positions onto the colloid retaining surface of such a belt in superimposed relation to provide a polychromic image, and thereafter bring the substrate into contact with the colloid retaining surface of the belt to cause transfer of the polychromic image from the colloid retaining surface onto the substrate and to thereby imprint the substrate with the polychromic image. As explained in Applicant's U.S. Pat. No. 5,908,541 of Jun. 1, 1999, the teaching of which is incorporated herein by reference, by utilizing an endless non-extensible belt having a colloid retaining surface such as a porous surface on which dots of colored, coagulated colloid can be transferred and by moving such a belt independently of the positive electrode, from one printing unit to another, so that the colloid retaining surface of the belt contacts the colored, coagulated colloid in sequence, it is possible to significantly improve the registration of the differently colored images upon their transfer onto the colloid retaining surface of the belt, thereby providing a polychromic image of high definition which can thereafter be transferred onto the paper web or other substrate. For example, use can be made of a belt comprising a plastic material having a porous coating of silica.

Accordingly, the present invention also provides, in a further aspect thereof, an improved multicolor electrocoagulation printing method comprising the steps of:

a) providing a positive electrolytically inert electrode having a continuous passivated surface moving at substantially constant speed along a predetermined path, the passivated surface defining a positive electrode active surface;

b) forming on the positive electrode active surface a plurality of dots of colored, coagulated colloid representative of a desired image, by electrocoagulation of an electrolytically coagulable colloid present in an electrocoagulation printing ink comprising a liquid colloidal dispersion containing the electrolytically coagulable colloid, a dispersing medium, a soluble electrolyte and a coloring agent;

c) bringing an endless non-extensible belt having a porous surface on one side thereof and moving at substantially the same speed as the positive electrode active surface, into contact with the positive electrode active surface to cause transfer of the dots of colored, coagulated colloid from the positive electrode active surface onto the porous surface of the belt and to thereby imprint the porous surface with the image;

d) repeating steps (b) and (c) several times to define a corresponding number of printing stages arranged at predetermined locations along the path and each using a coloring agent of different color, to thereby produce several differently colored images of coagulated colloid which are transferred at respective transfer positions onto the porous surface in superimposed relation to provide a polychromic image; and e) bringing a substrate into contact with the porous surface of the belt to cause transfer of the polychromic image from the porous surface onto the substrate and to thereby imprint the substrate with the polychromic image; the improvement wherein step (b) is carried out as defined above.

According to yet another aspect of the invention, there is provided an improved electrocoagulation printing apparatus comprising:

a positive electrolytically inert electrode having a continuous passivated surface defining a positive electrode active surface;

means for moving the positive electrode active surface at a substantially constant speed along a predetermined path;

an endless non-extensible belt having a porous surface on one side thereof;

means for moving the belt at substantially the same speed as the positive electrode active surface;

a plurality of printing units arranged at predetermined locations along the path, each printing unit comprising:

means for forming on the positive electrode active surface a plurality of dots of colored, coagulated colloid representative of a desired image, by electrocoagulation of an electrolytically coagulable colloid present in an electrocoagulation printing ink comprising a liquid colloidal dispersion containing the electrolytically coagulable colloid, a dispersion medium, a soluble electrolyte and a coloring agent, and means for bringing the belt into contact with the positive electrode active surface at a respective transfer station to cause transfer of the dots of colored, coagulated colloid from the positive electrode active surface onto the porous surface of the belt and to imprint the porous surface with the image, thereby producing several differently colored images of coagulated colloid which are transferred at the respective transfer stations onto the porous surface in superimposed relation to provide a polychromic image; and means for bringing a substrate into contact with the porous surface of the belt to cause transfer of the polychromic image from the porous surface onto the substrate and to thereby imprint the substrate with the polychromic image;

the improvement wherein the means for forming the dots of colored, coagulated colloid are as defined above.

The positive electrode used can be in the form of a moving endless belt as described in Applicant's U.S. Pat. No. 4,661,222, or in the form of a revolving cylinder as described in Applicant's U.S. Pat. Nos. 4,895,629 and 5,538,601, the teachings of which are incorporated herein by reference. In the latter case, the printing stages or units are arranged around the positive cylindrical electrode. Preferably, the positive electrode active surface and the ink are maintained at a temperature of about 35–60° C., preferably 40° C., to increase the viscosity of the coagulated colloid in step (b) so that the dots of colored, coagulated colloid remain coherent during their transfer in step (c), thereby enhancing transfer of the colored, coagulated colloid onto the substrate or belt. For example, the positive electrode active surface can be heated at the desired temperature and the ink applied on the heated electrode surface to cause a transfer of heat therefrom to the ink.

Where the positive cylindrical electrode extends vertically, step (b)(ii) of the above electrocoagulation printing method is advantageously carried out by continuously discharging the ink onto the positive electrode active surface from a fluid discharge means disposed adjacent the electrode gap at a predetermined height relative to the positive electrode and allowing the ink to flow downwardly along the positive electrode active surface, the ink being thus carried by the positive electrode upon rotation thereof to the electrode gap to fill same. Preferably, excess ink flowing downwardly off the positive electrode active surface is collected and the collected ink is recirculated back to the fluid discharge means.

The colloid generally used is a linear colloid of high molecular weight, that is, one having a weight average molecular weight between about 10,000 and about 1,000,000, preferably between 100,000 and 600,000. Examples of suitable colloids include natural polymers such as albumin, gelatin, casein and agar, and synthetic polymers such as polyacrylic acid, polyacrylamide and polyvinyl alcohol. A particularly preferred colloid is an anionic copolymer of acrylamide and acrylic acid having a weight average molecular weight of about 250,000 and sold by Cyanamid Inc. under the trade mark ACCOSTRENGTH 86. Water is preferably used as the medium for dispersing the colloid to provide the desired colloidal dispersion.

The ink also contains a soluble electrolyte and a coloring agent. Preferred electrolytes include alkali metal halides and alkaline earth metal halides, such as lithium chloride, sodium chloride, potassium chloride and calcium chloride. Potassium chloride is particularly preferred. The coloring agent can be a dye or a pigment. Examples of suitable dyes which may be used to color the colloid are the water soluble dyes available from HIOECHST such as Duasyn Acid Black for coloring in black and Duasyn Acid Blue for coloring in cyan, or those available from RIEDEL-DEHAEN such as Anti-Halo Dye Blue T. Pina for coloring in cyan, Anti-Halo Dye AC Magenta Extra V01 Pina for coloring in magenta and Anti-Halo Dye Oxonol Yellow N. Pina for coloring in yellow. When using a pigment as a coloring agent, use can be made of the pigments which are available from CABOT CORP. such as Carbon Black Monarch® 120 for coloring in black, or those available from HOECHST such as Hostaperm Blue B2G or B3G for coloring in cyan, Permanent Rubine F6B or L6B for coloring in magenta and Permanent Yellow DGR or DHG for coloring in yellow. A dispersing agent is added for uniformly dispersing the pigment into the ink. Examples of suitable dispersing agents include the anionic dispersing agent sold by Boehme Filatex Canada Inc. under the trade mark CLOSPERSE 25000.

After coagulation of the colloid, any remaining non-coagulated colloid is removed from the positive electrode active surface, for example, by scraping the surface with a soft rubber squeegee, so as to fully uncover the colored, coagulated colloid. Preferably, the non-coagulated colloid thus removed is collected and mixed with the collected ink, and the collected non-coagulated colloid in admixture with the collected ink is recirculated back to the aforesaid fluid discharge means.

The optical density of the dots of colored, coagulated colloid may be varied by varying the voltage and/or pulse duration of the pulse-modulated signals applied to the negative electrodes.

After step (c), the positive electrode active surface is generally cleaned to remove therefrom any remaining coagulated colloid. According to a preferred embodiment, the positive electrode is rotatable in a predetermined direction and any remaining coagulated colloid is removed from the positive electrode active surface by providing an elongated rotatable brush extending parallel to the longitudinal axis of the positive electrode, the brush being provided with a plurality of radially extending bristles made of horsehair and having extremities contacting the positive electrode active surface, rotating the brush in a direction opposite to the direction of rotation of the positive electrode so as to cause the bristles to frictionally engage the positive electrode active surface, and directing jets of cleaning liquid under pressure against the positive electrode active surface, from either side of the brush. In such an embodiment, the positive electrode active surface and the ink are preferably maintained at a temperature of about 35–60° C. by heating the cleaning liquid to thereby heat the positive electrode active surface upon contacting same and applying the ink on the heated electrode surface to cause a transfer of heat therefrom to the ink.

Preferably, the electrocoagulation printing ink contains water as the dispersing medium and the dots of differently colored, coagulated colloid representative of the polychromic image are moistened between the aforementioned steps (d) and (e) so that the polychromic image is substantially completely transferred onto the substrate in step (e).

According to another preferred embodiment, the substrate is in the form of a continuous web and step (e) is carried out by providing a support roller and a pressure roller extending parallel to the support roller and pressed thereagainst to form a nip through which the belt is passed, the support roller and pressure roller being driven by the belt upon movement thereof, and guiding the web so as to pass through the nip between the pressure roller and the porous surface of the belt for imprinting the web with the polychromic image. Preferably, the belt with the porous surface thereof imprinted with the polychromic image is guided so as to travel along a path extending in a plane intersecting the longitudinal axis of the positive electrode at right angles, thereby exposing the porous surface to permit contacting thereof by the web. Where the longitudinal axis of the positive electrode extends vertically, the belt is preferably guided so as to travel along a horizontal path with the porous surface facing downwardly, the support roller and pressure roller having rotation axes disposed in a plane extending perpendicular to the horizontal path. Such an arrangement is described in the aforementioned U.S. Pat. No. 5,908,541.

After step (e), the porous surface of the belt is generally cleaned to remove therefrom any remaining coagulated colloid. According to a preferred embodiment, any remaining coagulated colloid is removed from the porous surface of the belt by providing at least one elongated rotatable brush disposed on the one side of the belt and at least one support roller extending parallel to the brush and disposed on the opposite side of the belt, the brush and support roller having rotation axes disposed in a plane extending perpendicular to the belt, the brush being provided with a plurality of radially extending bristles made of horsehair and having extremities contacting the porous surface, rotating the brush in a direction opposite to the direction of movement of the belt so as to cause the bristles to frictionally engage the porous surface while supporting the belt with the support roller, directing jets of cleaning liquid under pressure against the porous surface from either side of the brush and removing the cleaning liquid with any dislodged coagulated colloid from the porous surface.

BRIEF DESCRIPTION OF THE DRAWINGS

Further features and advantages of the invention will become more readily apparent from the description of preferred embodiments as illustrated by way of examples in the accompanying drawings, in which.

DESCRIPTION OF PREFERRED EMBODIMENTS

Figure 2:
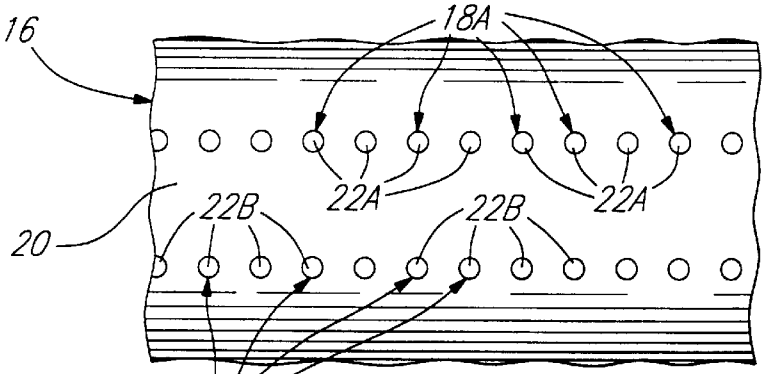
FIG. 2 is a fragmentary longitudinal view of the printing head illustrated in FIG. 1.
Figure 1:
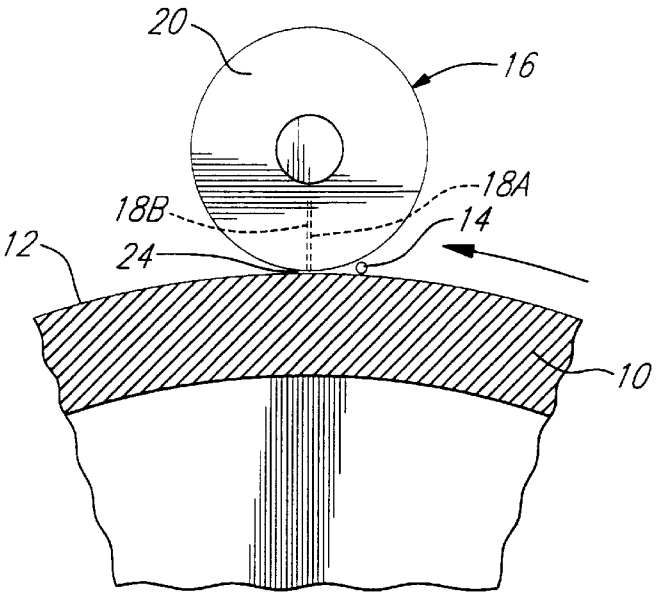
FIG. 1 is a fragmentary sectional view of an electrocoagulation printing apparatus according to a preferred embodiment of the invention, showing one printing head with two series of negative electrodes.

Referring first to FIG. 1, there is illustrated a positive electrode 10 in the form of a revolving cylinder and having a passivated surface 12 defining a positive electrode active surface adapted to be coated with an olefinic substance by means of a positive electrode coating device (not shown). A device 14 is provided for discharging an electrocoagulation printing ink onto the surface 12. The electrocoagulation printing ink consists of a colloidal dispersion containing an electrolytically coagulable colloid, a dispersing medium, a soluble electrolyte and a coloring agent. A printing head 16 having two series of negative electrodes 18A,18B is used for electrocoagulating the colloid contained in the ink to form on the positive electrode surface 12 dots of colored, coagulated colloid representative of a desired image. As shown in FIG. 2, the printing head 16 comprises a cylindrical electrode carrier 20 with the respective negative electrodes 18A, 18B of each series being electrically insulated from one another and arranged in rectilinear alignment along the length of the electrode carrier 20 to define a plurality of corresponding negative active surfaces 22A,22B. The two series of negative electrodes 18A, 18B are arranged in a close spaced-apart parallel relationship. The printing head 16 is positioned relative to the positive electrode 10 such that the surfaces 22A,22B of the negative electrodes 18A,18B are disposed in a plane which is spaced from the positive electrode surface 12 by a constant predetermined gap 24. The respective electrodes 18A, 18B of each series are also spaced from one another by a distance at least equal to the electrode gap 24 to prevent edge corrosion of the negative electrodes. The device 14 is positioned adjacent the electrode gap 24 to fill same with the electrocoagulation printing ink.

Figure 3:
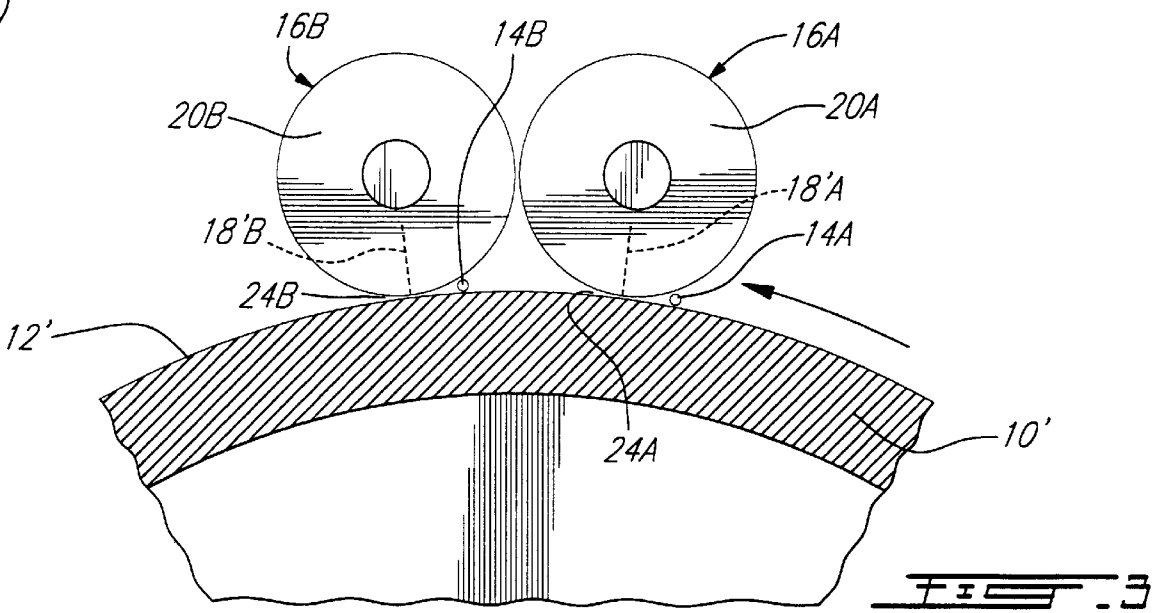
FIG. 3 is a fragmentary sectional view of an electrocoagulation printing apparatus according to another preferred embodiment of the invention, showing two printing heads each having a respective series of negative electrodes.
Figure 5:
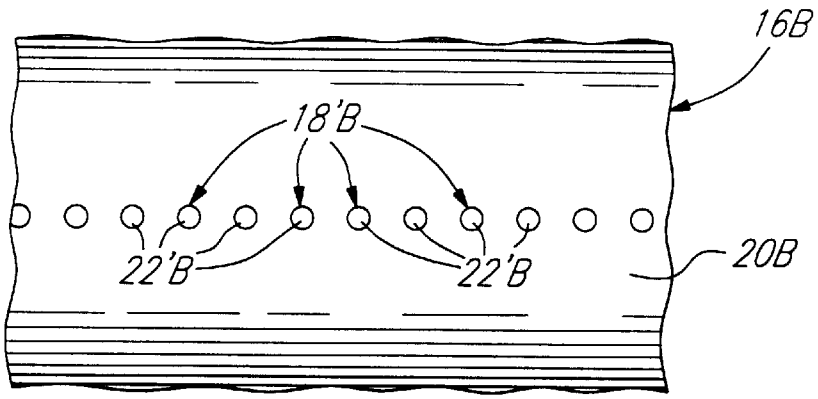
FIG. 5 is a fragmentary longitudinal view of the other printing head illustrated in FIG. 3.
Figure 4:
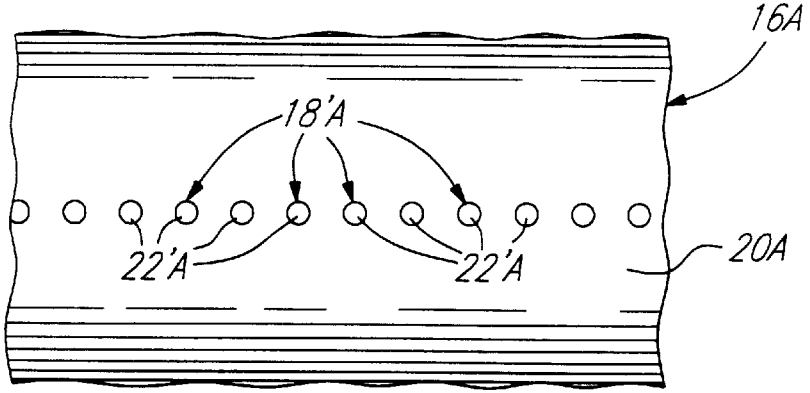
FIG. 4 is a fragmentary longitudinal view of one of the printing heads illustrated in FIG. 3.

Instead of using a single printing head 16 with two series of negative electrodes 18A,18B, it is also possible to use two printing heads 16A, 16B each having a respective series of negative electrodes 18'A, 18'B, as in the embodiment illustrated in FIGS. 3–5. As shown, the first printing head 16A comprises a cylindrical electrode carrier 20A with the series of negative electrodes 18'A being electrically insulated from one another and arranged in rectilinear alignment along the length of the electrode carrier 20A to define a plurality of corresponding negative electrode active surfaces 22'A. The printing head 16A is positioned relative to the positive electrode 10' such that the surfaces 22'A of the negative electrodes 18'A are disposed in a plane which is spaced from the positive electrode surface 12' by a constant predetermined gap 24A. The electrodes 18'A are also spaced from one another by a distance at least equal to the electrode gap 24A to prevent edge corrosion of the negative electrodes. A device 14A is associated with the printing head 16A and positioned adjacent the electrode gap 24A to fill same with the aforementioned electrocoagulation printing ink.

Similarly, the second printing head 16B comprises a cylindrical electrode carrier 20B with a series of negative electrodes 18'B being electrically insulated from one another and arranged in rectilinear alignment along the length of the electrode carrier 20B to define a plurality of corresponding negative electrode active surfaces 22'B. The printing head 16B is positioned relative to the positive electrode 10' such that the surfaces 22'B of the negative electrodes 18'B are disposed in a plane which is spaced from the positive electrode surface 12' by a constant predetermined gap 24B. The electrodes 18'B are also spaced from one another by a distance at least equal to the electrode gap 24B to prevent edge corrosion of the negative electrodes. A device 14B is associated with the printing head 16B and positioned adjacent the electrode gap 24B to fill same with the aforementioned electrocoagulation printing ink.

The printing heads 16A and 16B are disposed so that the series of negative electrodes 18'A and 18'B are arranged in spaced-apart parallel relationship.

Figure 6:
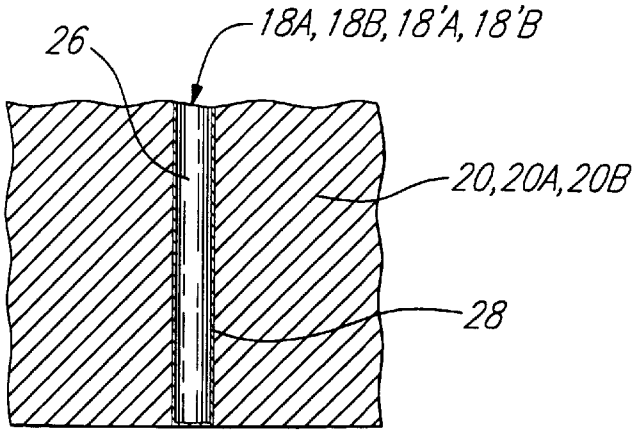
FIG. 6 is a fragmentary sectional view of one of the negative electrodes illustrated in FIGS. 1 and 3.

As shown in FIG. 6, the negative electrodes 18A, 18B, 18'A and 18'B each have a cylindrical body 26 made of an electrolytically inert metal and covered with a passive oxide film 28. The end surface of the electrode body 26 covered with such a film defines the aforementioned negative electrode active surface 22A, 22B, 22'A or 22'B.

Figure 7:
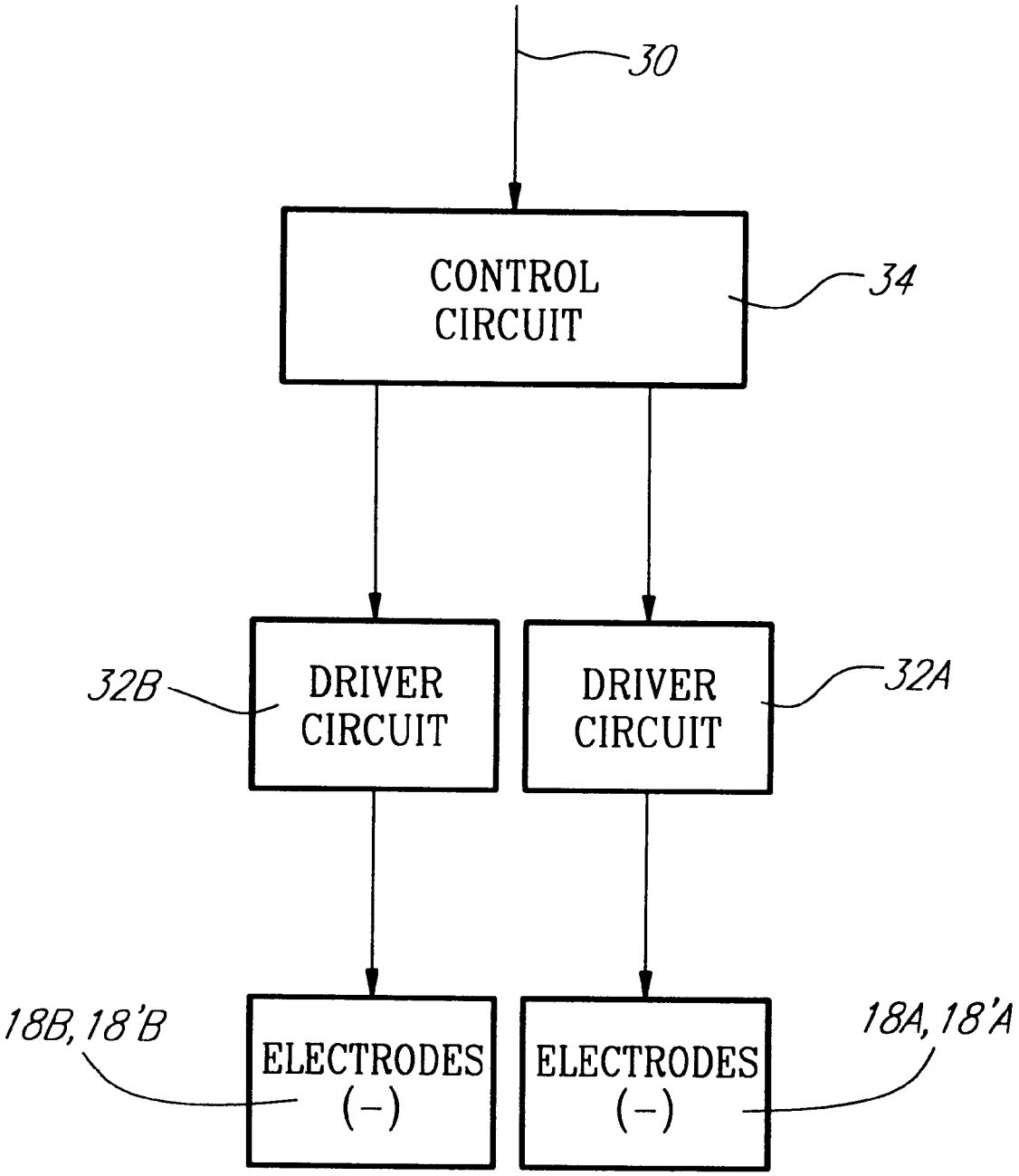
FIG. 7 is a schematic diagram showing how an input signal of information is processed to reproduce an image by electrocoagulation of a colloid.

FIG. 7 is a schematic diagram illustrating how the negative electrodes 18A, 18B or 18'A, 18'B are energized in response to an input signal of information 30 to form dots of colored, coagulated colloid representative of a desired image. As shown, a driver circuit 32A is used for addressing selected is ones of the negative electrodes 18A or 18'A so as to apply electric current to the selected negative electrodes. Similarly, a driver circuit 32B is used for addressing selected ones of the negative electrodes 18B or 18'B so as to apply electric current to the selected negative electrodes. Such an electrical energizing causes point-by-point selective coagulation and adherence of the colloid onto the olefin-coated surface 12 or 12' of the positive electrode 10 or 10' opposite the electrode active surfaces 22A, 22B, 22'A or 22'B while the electrode 10 or 10' is rotating, thereby forming on the surface 12 or 12' a series of corresponding dots of colored, coagulated colloid.

As previously explained, gas generated as a result of electrolysis and not consumed by reaction with the olefinic substance causes a breakdown of the passive oxide film 28 of each energized negative electrode 18A, 18B, 18'A or 18'B and a local dissolution of the film into the ink at the breakdown sites. In order to prevent an undesirable formation of the aforementioned gelatinous deposit, a control circuit 34 is used for activating the driver circuits 32A,32B in a controlled alternate manner such that the negative electrodes 18A or 18'A are energized prior to an undesirable formation of the gelatinous deposit on the electrode active surface 22B or 22'B of each energized electrode 18B or 18'B and the negative electrodes 18B or 18'B are energized prior to an undesirable formation of the gelatinous deposit on the electrode active surface 22A or 22'A of each energized electrode 18A or 18'A. By controlling the electrical energizing of the negative electrodes in such a manner, it is believed that the passive oxide film of each energized electrode does not dissolve into the ink in a quantity sufficient to cause an undesirable formation of the gelatinous deposit. Upon de-energizing the negative electrodes, the passive oxide film of each de-energized electrode rebuilds itself due to the presence of oxidizing substances in the ink.

Generally, selected ones of the negative electrodes 18A or 18'A and selected ones of the negative electrodes are energized in an alternate manner for a period of about 3 to 4 seconds. Preferably, the driver circuits 32A,32B are controlled by the control circuit 34 so as to provide a continuous formation of dots of colored, coagulated colloid. When it is desired to reproduce a polychromic image, use is preferably made of a central processing unit (CPU) for controlling the driver circuits associated with each color printing unit.

I claim:

1. In an electrocoagulation printing method comprising the steps of:

a) providing a positive electrolytically inert electrode having a continuous passivated surface moving at substantially constant speed along a predetermined path, said passivated surface defining a positive electrode active surface;

b) forming on said positive electrode active surface a plurality of dots of colored, coagulated colloid representative of a desired image, by electrocoagulation of an electrolytically coagulable colloid present in an electrocoagulation printing ink comprising a liquid colloidal dispersion containing said electrolytically coagulable colloid, a dispersing medium, a soluble electrolyte and a coloring agent; and c) bringing a substrate into contact with the dots of colored, coagulated colloid to cause transfer of the colored, coagulated colloid from the positive electrode active surface onto said substrate and thereby imprint said substrate with said image;

the improvement wherein step (b) is carried out by:

i) providing a first and a second series of negative electrolytically inert electrodes each having a surface covered with a passive oxide film, the negative electrodes of each series being electrically insulated from one another and arranged in rectilinear alignment so that the surfaces thereof define a plurality of corresponding negative electrode active surfaces disposed in a respective plane spaced from said positive electrode active surface by a respective constant predetermined gap, said first and second series of negative electrodes being arranged in spaced-apart parallel relationship with the negative electrodes of each series being spaced from one another by a distance at least equal to said respective electrode gap;

ii) coating said positive electrode active surface with an olefinic substance to form on the surface micro-droplets of olefinic substance;

iii) filling the electrode gaps with said electrocoagulation printing ink;

iv) electrically energizing selected ones of the negative electrodes of said first and second series in a controlled alternate manner such that the electrodes of said first series are energized prior to an undesirable formation of a gelatinous deposit on the electrode active surface of each energized electrode of said second series and the electrodes of said second series are energized prior to an undesirable formation of a further gelatinous deposit on the electrode active surface of each energized electrode of said first series, thereby causing point-by-point selective coagulation and adherence of the colloid onto the olefin-coated positive electrode active surface opposite the electrode active surfaces of said energized negative electrodes while said positive electrode active surface is moving; and v) removing any remaining non-coagulated colloid from said positive electrode active surface.

2. A method as claimed in claim 1, wherein the negative electrodes of each said series are mounted to a respective elongated electrode carrier along the length thereof.

3. A method as claimed in claim 2, wherein the negative electrodes of said first and second series each have a cylindrical configuration with a circular cross-section and a diameter ranging from about 20 to about 50 um.

4. A method as claimed in claim 1, wherein the negative electrodes of said first and second series are mounted to a single elongated electrode carrier along the length thereof.

5. A method as claimed in claim 4, wherein the negative electrodes of said first and second series each have a cylindrical configuration with a circular cross-section and a diameter ranging from about 20 to about 50 um, and wherein said first and second series of said negative electrodes are spaced from one another by a distance ranging from about 250 to about 1000 um.

6. A method as claimed in claim 1, wherein the negative electrodes of said first and second series are formed of an electrolytically inert metal selected from the group consisting of chromium, nickel, stainless steel and titanium.

7. A method as claimed in claim 6, wherein said electrolytically inert metal comprises stainless steel.

8. A method as claimed in claim 1, wherein in step (b)(iv) the energizing of the negative electrodes of said first and second series is controlled to provide a continuous formation of said dots of colored, coagulated colloid on said positive electrode active surface.

9. A method as claimed in claim 1, wherein steps (b) and (c) are repeated several times to define a corresponding number of printing stages arranged at predetermined locations along said path and each using a coloring agent of different color, to thereby produce several differently colored images of coagulated colloid which are transferred at respective transfer positions onto said substrate in superimposed relation to provide a polychromic image.

10. A method as claimed in claim 9, wherein said positive electrode is a cylindrical electrode having a central longitudinal axis and rotating at substantially constant speed about said longitudinal axis, and wherein said printing stages are arranged around said positive cylindrical electrode.

11. In a multicolor electrocoagulation printing method comprising the steps of:

a) providing a positive electrolytically inert electrode having a continuous passivated surface moving at substantially constant speed along a predetermined path, said passivated surface defining a positive electrode active surface;

b) forming on said positive electrode active surface a plurality of dots of colored, coagulated colloid representative of a desired image, by electrocoagulation of an electrolytically coagulable colloid present in an electrocoagulation printing ink comprising a liquid colloidal dispersion containing said electrolytically coagulable colloid, a dispersing medium, a soluble electrolyte and a coloring agent;

c) bringing an endless non-extensible belt having a porous surface on one side thereof and moving at substantially the same speed as said positive electrode, into contact with said positive electrode active surface to cause transfer of the dots of colored, coagulated colloid from the positive electrode active surface onto the porous surface of said belt and to thereby imprint said porous surface with the image;

d) repeating steps (b) and (c) several times to define a corresponding number of printing stages arranged at predetermined locations along said path and each using a coloring agent of different color, to thereby produce several differently colored images of coagulated colloid which are transferred at respective transfer positions onto said porous surface in superimposed relation to provide a polychromic image; and e) bringing a substrate into contact with the porous surface of said belt to cause transfer of the polychromic image from said porous surface onto said substrate and to thereby imprint said substrate with said polychromic image;

the improvement wherein step (b) is carried out by:

i) providing a first and a second series of negative electrolytically inert electrodes each having a surface covered with a passive oxide film, the negative electrodes of each series being electrically insulated from one another and arranged in rectilinear alignment so that the surfaces thereof define a plurality of corresponding negative electrode active surfaces disposed in a respective plane spaced from said positive electrode active surface by a respective constant predetermined gap, said first and second series of negative electrodes being arranged in spaced-apart parallel relationship with the negative electrodes of each series being spaced from one another by a distance at least equal to said respective electrode gap;

ii) coating said positive electrode active surface with an olefinic substance to form on the surface micro-droplets of olefinic substance;

iii) filling the electrode gaps with said electrocoagulation printing ink;

iv) electrically energizing selected ones of the negative electrodes of said first and second series in a controlled alternate manner such that the electrodes of said first series are energized prior to an undesirable formation of a gelatinous deposit on the electrode active surface of each energized electrode of said second series and the electrodes of said second series are energized prior to an undesirable formation of a further gelatinous deposit on the electrode active surface of each energized electrode of said first series, thereby causing point-by-point selective coagulation and adherence of the colloid onto the olefin-coated positive electrode active surface opposite the electrode active surfaces of said energized negative electrodes while said positive electrode active surface is moving; and v) removing any remaining non-coagulated colloid from said positive electrode active surface.

12. A method as claimed in claim 11, wherein the negative electrodes of each said series are mounted to a respective elongated electrode carrier along the length thereof.

13. A method as claimed in claim 12, wherein the negative electrodes of said first and second series each have a cylindrical configuration with a circular cross-section and a diameter ranging from about 20 to about 50 um.

14. A method as claimed in claim 11, wherein the negative electrodes of said first and second series are mounted to a single elongated electrode carrier along the length thereof.

15. A method as claimed in claim 14, wherein the negative electrodes of said first and second series each have a cylindrical configuration with a circular cross-section and a diameter ranging from about 20 to about 50 um, and wherein said first and second series of said negative electrodes are spaced from one another by a distance ranging from about 250 to 1000 um.

16. A method as claimed in claim 11, wherein the negative electrodes of said first and second series are formed of an electrolytically inert metal selected from the group consisting of chromium, nickel, stainless steel and titanium.

17. A method as claimed in claim 16, wherein said electrolytically inert metal comprises stainless steel.

18. A method as claimed in claim 11, wherein in step (b)(iv) the energizing of the negative electrodes of said first and second series is controlled to provide a continuous formation of said dots of colored, coagulated colloid on said positive electrode active surface.

19. A method as claimed in claim 11, wherein said positive electrode is a cylindrical electrode having a central longitudinal axis and rotating at substantially constant speed about said longitudinal axis, and wherein said printing stages are arranged around said positive cylindrical electrode.

20. In an electrocoagulation printing apparatus comprising:

a positive electrolytically inert electrode having a continuous passivated surface defining a positive electrode active surface;

means for moving said positive electrode active surface at a substantially constant speed along a predetermined path;

means for forming on said positive electrode active surface a plurality of dots of colored, coagulated colloid representative of a desired image, by electrocoagulation of an electrolytically coagulable colloid present in an electrocoagulation printing ink comprising a liquid colloidal dispersion containing said electrolytically coagulable colloid, a dispersing medium, a soluble electrolyte and a coloring agent; and means for bringing a substrate into contact with the dots of colored, coagulated colloid to cause transfer of the colored, coagulated colloid from the positive electrode active surface onto said substrate and thereby imprint said substrate with said image;

the improvement wherein said means for forming said dots of colored, coagulated colloid comprise:

a first and a second series of negative electrolytically inert electrodes each having a surface covered with a passive oxide film, the negative electrodes of each series being electrically insulated from one another and arranged in rectilinear alignment so that the surfaces thereof define a plurality of corresponding negative electrode active surfaces disposed in a respective plane spaced from said positive electrode active surface by a respective constant predetermined gap, said first and second series of negative electrodes being arranged in spaced-apart parallel relationship with the negative electrodes of each series being spaced from one another by a distance at least equal to said respective electrode gap;

means for coating said positive electrode active surface with an olefinic substance to form on the surface micro-droplets of olefinic substance;

means for filling the electrode gaps with said electrocoagulation printing ink;

means for electrically energizing selected ones of the negative electrodes of said first and second series in a controlled alternate manner such that the electrodes of said first series are energized prior to an undesirable formation of a gelatinous deposit on the electrode active surface of each energized electrode of said second series and the electrodes of said second series are energized prior to an undesirable formation of a further gelatinous deposit on the electrode active surface of each energized electrode of said first series, thereby causing point-by-point selective coagulation and adherence of the colloid onto the olefin-coated positive electrode active surface opposite the electrode active surfaces of said energized negative electrodes while said positive electrode active surface is moving; and means for removing any remaining non-coagulated colloid from said positive electrode active surface.

21. An apparatus as claimed in claim 20, wherein the negative electrodes of each said series are mounted to a respective elongated electrode carrier along the length thereof.

22. An apparatus as claimed in claim 21, wherein the negative electrodes of said first and second series each have a cylindrical configuration with a circular cross-section and a diameter ranging from about 20 to about 50 um.

23. An apparatus as claimed in claim 20, wherein the negative electrodes of said first and second series are mounted to a single elongated electrode carrier along the length thereof.

24. An apparatus as claimed in claim 23, wherein the negative electrodes of said first and second series each have a cylindrical configuration with a circular cross-section and a diameter ranging from about 20 to about 50 um, and wherein said first and second series of said negative electrodes are spaced from one another by a distance ranging from about 250 to about 1000 um.

25. An apparatus as claimed in claim 20, wherein the negative electrodes of said first and second series are formed of an electrolytically inert metal selected from the group consisting of chromium, nickel, stainless steel and titanium.

26. An apparatus as claimed in claim 25, wherein said electrolytically inert metal comprises stainless steel.

27. An apparatus as claimed in claim 20, wherein said means for energizing the negative electrodes of said first and second series include first driver circuit means for addressing selected ones of the negative electrodes of said first series so as to apply electric current to the selected negative electrodes, second driver circuit means for addressing selected ones of the negative electrodes of said second series so as to apply electric current to the selected negative electrodes, and control means for activating said first and second drive circuit means in said controlled alternate manner.

28. An apparatus as claimed in claim 27, wherein said control means comprises a central processing unit.

29. An apparatus as claimed in claim 27, wherein said control means is adapted to cooperate with said first and second driver circuit means so as to provide a continuous formation of said dots of colored, coagulated colloid on said positive electrode active surface.

30. An apparatus as claimed in claim 20, wherein said means for forming said dots of colored, coagulated colloid and said means for bringing said substance into contact with said dots of colored, coagulated colloid are arranged to define a printing unit, and wherein there are several printing units positioned at predetermined locations along said path and each using a coloring agent of different colored for producing several differently transferred at respective transfer stations onto said substrate in superimposed relation to provide a polychromic image.

31. An apparatus as claimed in claim 30, wherein said positive electrode is a cylindrical electrode having a central longitudinal axis and wherein said means for moving said positive electrode active surface includes means for rotating said positive cylindrical electrode about said longitudinal axis, and wherein said printing units being arranged around said positive cylindrical electrode.

32. In a multicolor electrocoagulation printing apparatus comprising:

a positive electrolytically inert electrode having a continuous passivated surface defining a positive electrode active surface;

means for moving said positive electrode active surface at a substantially constant speed along a predetermined path;

an endless non-extensible belt having a porous surface on one side thereof, means for moving said belt at substantially the same speed as said positive electrode active surface;

a plurality of printing units arranged at predetermined locations along said path, each printing unit comprising:

means for forming on said positive electrode active surface a plurality of dots of colored, coagulated colloid representative of a desired image, by electrocoagulated of an electrolytically coagulable colloid present in an electrocoagulation printing ink comprising a liquid colloidal dispersion containing said electrolytically coagulable colloid, a dispersion medium, a soluble electrolyte and a coloring agent, and means for bringing said belt into contact with said positive electrode active surface at a respective transfer station to cause transfer of the dots of colored, coagulated colloid from the positive electrode active surface onto the porous surface of said belt and to imprint said porous surface with the image, thereby producing several differently colored images of coagulated colloid which are transferred at said respective transfer stations onto said porous surface in superimposed relation to provide a polychromic image; and means for bringing a substrate into contact with the porous surface of said belt to cause transfer of the polychromic image from said porous surface onto said substrate and to thereby imprint said substrate with said polychromic image;

the improvement wherein said means for forming said dots of colored, coagulated colloid comprise:

a first and a second series of negative electrolytically inert electrodes each having a surface covered with a passive oxide film, the negative electrodes of each series being electrically insulated from one another and arranged in rectilinear alignment so that the surfaces thereof define a plurality of corresponding negative electrode active surfaces disposed in a respective plane spaced from said positive electrode active surface by a respective constant predetermined gap, said first and second series of negative electrodes being arranged in spaced-apart parallel relationship with the negative electrodes of each series being spaced from one another by a distance at least equal to said respective electrode gap;

means for coating said positive electrode active surface with an olefinic substance to form on the surface micro-droplets of olefinic substance;

means for filling the electrode gaps with said electrocoagulation printing ink;

means for electrically energizing selected ones of the negative electrodes of said first and second series in a controlled alternate manner such that the electrodes of said first series are energized prior to an undesirable formation of a gelatinous deposit on the electrode active surface of each energized electrode of said second series and the electrodes of said second series are energized prior to an undesirable formation of a further gelatinous deposit on the electrode active surface of each energized electrode of said first series, thereby causing point-by-point selective coagulation and adherence of the colloid onto the olefin-coated positive electrode active surface opposite the electrode active surfaces of said energized negative electrodes while said positive electrode active surface is moving; and means for removing any remaining non-coagulated colloid from said positive electrode active surface.

33. An apparatus as claimed in claim 32, wherein the negative electrodes of each said series are mounted to a respective elongated electrode carrier along the length thereof.

34. An apparatus as claimed in claim 33, wherein the negative electrodes of said first and second series each have a cylindrical configuration with a circular cross-section and a diameter ranging from about 20 to about 50 um.

35. An apparatus as claimed in claim 32, wherein the negative electrodes of said first and second series are mounted to a single elongated electrode carrier along the length thereof.

36. An apparatus as claimed in claim 35, wherein the negative electrodes of said first and second series each have a cylindrical configuration with a circular cross-section and a diameter ranging from about 20 to about 50 um, and wherein said first and second series of said negative electrodes are spaced from one another by a distance ranging from about 250 to about 1000 um.

37. An apparatus as claimed in claim 32, wherein the negative electrodes of said first and second series are formed of an electrolytically inert metal selected from the group consisting of chromium, nickel, stainless steel and titanium.

38. An apparatus as claimed in claim 37, wherein said electrolytically inert metal comprises stainless steel.

39. An apparatus as claimed in claim 32, wherein said means for energizing the negative electrodes of said first and second series include first driver circuit means for addressing selected ones of the negative electrodes of said first series so as to apply electric current to the selected negative electrodes, second driver circuit means for addressing selected ones of the negative electrodes of said second series so as to apply electric current to the selected negative electrodes, and control means for activating said first and second drive circuit means in said controlled alternate manner.

40. An apparatus as claimed in claim 39, wherein said control means comprises a central processing unit.

41. An apparatus as claimed in claim 39, wherein said control means is adapted to cooperate with said first and second driver circuit means so as to provide a continuous formation of said dots of colored, coagulated colloid on said positive electrode active surface.

42. An apparatus as claimed in claim 32, wherein said positive electrode is a cylindrical electrode having a central longitudinal axis and wherein said means for moving said positive electrode active surface includes means for rotating said positive cylindrical electrode about said longitudinal axis, said printing units being arranged around said positive cylindrical electrode.

* * * * *